US007340801B2

(12) United States Patent
Yamaguchi

(10) Patent No.: US 7,340,801 B2
(45) Date of Patent: Mar. 11, 2008

(54) STAY

(75) Inventor: Koshi Yamaguchi, Gunma (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 183 days.

(21) Appl. No.: 10/530,631

(22) PCT Filed: Oct. 9, 2003

(86) PCT No.: PCT/JP03/12975

§ 371 (c)(1),
(2), (4) Date: Apr. 7, 2005

(87) PCT Pub. No.: WO2004/035972

PCT Pub. Date: Apr. 29, 2004

(65) Prior Publication Data

US 2006/0048339 A1 Mar. 9, 2006

(30) Foreign Application Priority Data

Oct. 15, 2002 (JP) ..... 2002-299932

(51) Int. Cl.
*E05D 15/00* (2006.01)

(52) U.S. Cl. ..... 16/368; 16/324; 16/326

(58) Field of Classification Search ..... 16/368, 16/324, 326, 325, 327, 352, 357; 49/324, 49/345, 248–250, 394, 251–252; 403/62, 403/91, 93, 96, 102, 103
See application file for complete search history.

(56) References Cited

U.S. PATENT DOCUMENTS 1,136,444 A * 4/1915 Schubert ..... 292/263

(Continued)

FOREIGN PATENT DOCUMENTS

EP 0649965 4/1995

(Continued)

OTHER PUBLICATIONS

Supplementary European Search Report dated Nov. 19, 2007 (3 pages).

*Primary Examiner*—Chuck Y. Mah
(74) *Attorney, Agent, or Firm*—Osha Liang, LLP

(57) ABSTRACT

The basal end part of a second arm is turnably connected to the leading end part of the first arm. An engagement recess is formed in the leading end face of the first arm. The second arm is provided at its basal end part with a lock member such that the lock member is movable in the longitudinal direction of the second arm, and the lock member is biased toward the basal end of the second arm by a tension coiled spring. The lock member is provided with an engagement pin engageable with the engagement recess through a roller so that the first arm and the second arm are non-turnably locked. A turnable member is turnably disposed on the lock member and abutted with the roller by a tension coiled spring. An abutment surface of the turnable member is abutted with an arcuate surface formed on the leading end part of the first arm. By this, the lock member is brought into a release retaining position where the roller is brought out of the engagement recess.

6 Claims, 3 Drawing Sheets

U.S. PATENT DOCUMENTS

| | | | | | |
|---|---|---|---|---|---|
| 1,851,630 | A | | 3/1932 | Johnson | |
| 1,966,205 | A | | 7/1934 | Johnson | |
| 2,064,839 | A | * | 12/1936 | Kroll et al. | 16/324 |
| 2,295,421 | A | | 9/1942 | Morgen | |
| 2,803,033 | A | * | 8/1957 | Rachman et al. | 16/326 |
| 3,259,936 | A | | 7/1966 | Sheridan | |
| 3,368,423 | A | * | 2/1968 | Fazekas et al. | 74/165 |
| 3,563,592 | A | * | 2/1971 | Preston | 292/263 |
| 3,643,292 | A | * | 2/1972 | Mayer | 16/325 |
| 3,680,448 | A | * | 8/1972 | Ballingall et al. | 52/169.12 |
| 3,825,290 | A | * | 7/1974 | Messina et al. | 292/262 |
| 4,068,601 | A | * | 1/1978 | Marsh et al. | 108/134 |
| 4,930,186 | A | | 6/1990 | Linwu | |
| 5,142,739 | A | * | 9/1992 | Lin | 16/326 |
| 5,681,045 | A | * | 10/1997 | Liao | 273/400 |
| 6,561,724 | B1 | * | 5/2003 | Carletti | 403/315 |

FOREIGN PATENT DOCUMENTS

| | | | | |
|---|---|---|---|---|
| EP | 891889 | A1 | * | 1/1999 |
| FR | 2244097 | A | * | 5/1975 |
| JP | S63-148777 | | | 9/1988 |
| JP | H06-040823 | | | 10/1994 |
| JP | 11324462 | A | * | 11/1999 |
| JP | 2001-115720 | | | 4/2001 |

* cited by examiner

STAY

TECHNICAL FIELD

This invention relates to a stay for maintaining a door in an open position, and more particularly to a stay having a lock function.

BACKGROUND ART

In general, a stay of this type includes a first arm turnably connected at a basal end part thereof to a skeleton, a second arm connected at a basal end part thereof to a leading end part of the first arm such that the second arm can turn between a development position and a folded position, a lock member disposed at the second arm in such a manner as to be movable toward and away from the first arm, and a lock biasing means for biasing the lock member toward the first arm. An engagement recess is formed in the leading end part of the first arm. When the second arm is turned to the development position, the lock member is brought into the engagement recess, thereby the second arm is locked at the development position. Moreover, since the lock member is biased toward the first arm by the lock biasing means, the locked state is reliably maintained. By this, the door is maintained in the open position. The locked state can be released by moving the lock member against the biasing force of the lock biasing means and bringing the lock member out of the engagement recess. In that state, the second arm can be turned from the development position toward the folded position. Accordingly, the door can be turned from the open position toward the closed position (see Japanese Utility Model Application Laid-Open No. S63-148777).

In the above-mentioned conventional stay, in case the door is to be turned from the open position toward the closed position by only one person, it is required for this person to maintain the escaped state of the lock member from the engagement recess with one hand, while turning the door toward the closed position with the other hand. This is a difficult job. This is particularly true when the door is large. In case two stays are used in order to cope with a large door, for example, in case two stays are installed one at the left side and the other at the right side of a door which is to be opened upward, the locked states of the two stays must be released simultaneously. It gives rise to a problem that the door cannot be turned from the open position toward the closed position by only one person.

DISCLOSURE OF THE INVENTION

The present invention is accomplished in order to solve the above-mentioned problem. According to the invention, there is provided a stay including a first arm, a second arm whose basal end part is turnably connected to a leading end part of the first arm between a development position and a folded position, and a lock means disposed between the first arm and the second arm, the lock means being switched between a locked state where the second arm can non-turnably be locked in the development position and a released state where the second arm is allowed to turn from the development position to the folded position, wherein the stay further includes a retaining means for retaining the lock means in the released state when the second arm is located in the development position.

It is preferred that the lock means includes a lock member movably disposed at the second arm within a predetermined movable range and a lock biasing means for biasing the lock member, when the lock member is moved to a predetermined locked position within the movable range with the second arm 2 located in the development position, the lock member is engaged with the first arm to prohibit the second arm from turning from the development position toward the folded position and when the lock member is moved away from the locked position by a predetermined releasing distance or more with the second arm located in the development position, the lock member is disengaged from the first arm to allow the second arm to turn from the development position toward the folded position, the lock biasing means biasing the lock member toward the locked position, so that the engaging state of the lock member with the first arm can be maintained.

Preferably, the retaining means is a movement prohibiting means disposed between selected one of the first and second arms and the lock member and adapted to prohibit the lock member from moving toward the locked position beyond a predetermined release retaining position which is away by more than the releasing distance from the locked position.

It is preferred that the movement prohibiting means is disposed between the first arm and the lock member, the movement prohibiting means includes a displacement member disposed at the lock member such that the displacement member can displace between a first position and a second position, a displacement biasing means for biasing the displacement member from the first position toward the second position, a first abutment part disposed at the first arm, the first abutment part being abutted with the displacement member so that the displacement member is brought into the first position when the second arm is located at the development position and the lock member is located at the locked position and allowing the displacement member to move to the second position when the lock member is moved beyond the release retaining position, a second abutment part disposed at the lock member and abutted with the displacement member so that the placement member is brought into the second position against the biasing force of the displacement biasing means, and a third abutment part disposed at the first arm and abutted with the displacement member which is located at the second position, thereby prohibiting the lock member from moving from the release retaining position toward the locked position.

Preferably, the first arm is provided with an engagement recess formed therein and partly open, and the first arm is provided with an engagement part formed thereon, the engagement part being brought into engagement with the engagement recess through an opening part of the engagement recess thereby prohibiting the second arm from turning toward the folded position from the development position when the second arm is located at the development position and the lock member is moved from the release retaining position to the locked position.

It is preferred that the first abutment part is formed as an inclination surface which is inclined in such a manner as to approach the opening part of the engagement recess from the locked position toward the release retaining position, and the third abutment part is formed as a distal end part of the inclination surface which is intersected with an end part on the opening side of one side surface of the engagement recess.

Preferably, the displacement member is turnably disposed at the lock member, the engagement part is also used as the second abutment part, the displacement member is abutted with a rear end part, which is away from the engagement recess, of the inclination surface, thereby causing the displacement to be located at the first position when the second arm is located at the development position and the lock member is located at the locked position, the displacement member is slid on the inclination surface and turned toward the second position as the lock member is moved from the locked position toward the release retaining position, and the displacement member is moved beyond the inclination surface and abutted with the engagement part thereby being located at the second position when the lock member reaches the release retaining position.

It is preferred that when the second arm is turned from the folded position toward the development position with the lock member located in a moving limit position toward the first arm within the predetermined movable range, the engagement part is brought into abutment with the inclination surface, thereby the lock member moves toward the release retaining position in accordance with turning movement of the second arm against the biasing force of the lock biasing means, and when the second arm reaches the development position, the lock member is moved to the locked position by the lock biasing means, thereby the engagement part is inserted into the engagement recess through the opening part of the engagement recess.

Preferably, when the lock member is moved to the locked position by the lock biasing means, the displacement member is moved by the inclination surface from the second position to the first position against the biasing force of the displacement biasing means.

BEST MODE FOR CARRYING OUT THE INVENTION

Figure 1:
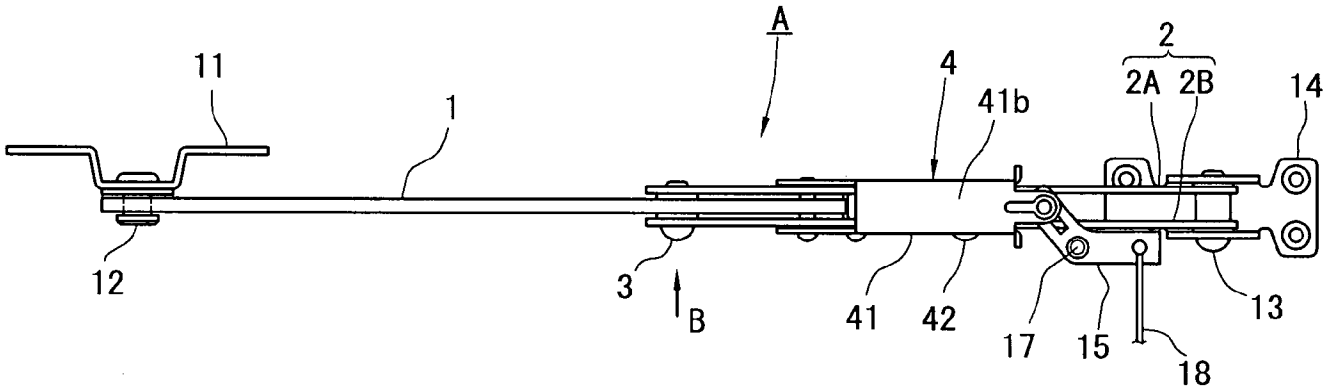
FIG. 1(A) is a front view showing one embodiment of the present invention.
FIG. 1(B) is a view, when viewed in a direction as indicated by an arrow B of FIG. 1(A).
Figure 1:
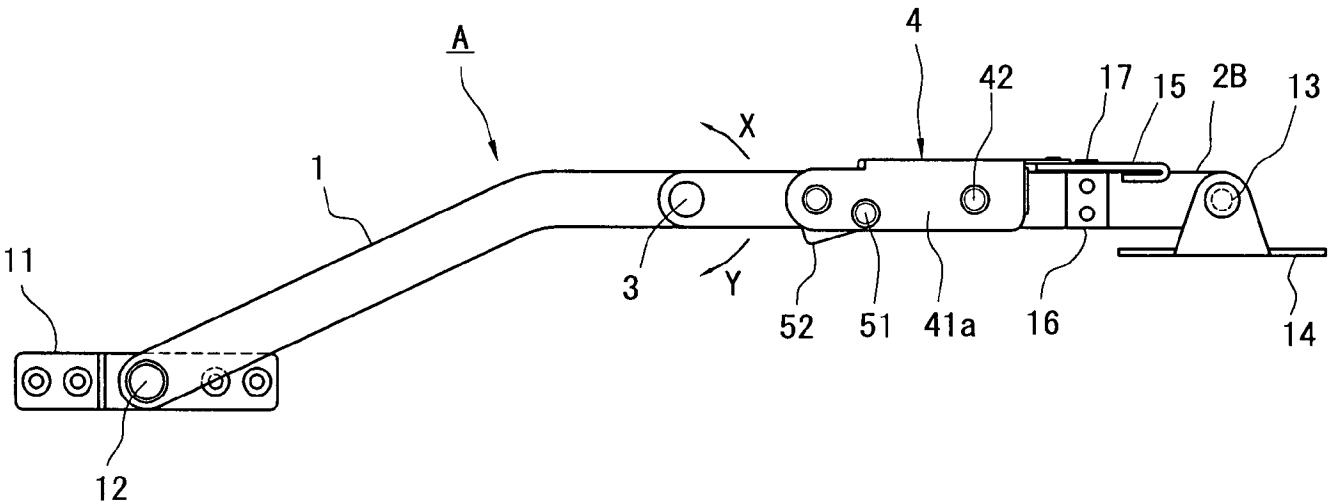

One embodiment of the present invention will be described hereinafter with reference to FIGS. 1(A) through 3(D).

As shown in FIGS. 1(A) and 1(B), a stay A includes a first arm 1 and a second arm 2. The first arm 1 is formed generally in a dogleg shape obtained by bending an elongate flat plate in the widthwise direction. A skeleton side attachment member 11 is turnably attached to a basal end part of the first arm 1 through a pin 12. The skeleton attachment member 11 is attached to an upper surface of an opening part of a skeleton (not shown), thereby horizontally turnably connecting the basal end part of the first arm 1 to the skeleton. In other words, the first arm 1 is turnably connected to the skeleton with an axis of the pin 12 directing in the up and down direction. In case the stay A is used for a door which can be opened upward, the first arm 1 is attached to a side surface facing in the left and light direction of the opening part of the skeleton with the axis of the pin 12 directing in the horizontal direction.

The second arm 2 includes a pair of elongate flat plates 2A, 2B disposed opposite to each other. A leading end part of the first arm 1 is inserted between basal end parts of the pair of flat plates 2A, 2B. The basal end parts of the flat plates 2A, 2B are turnably connected to the leading end part, i.e., a part slightly offset toward the basal end from the leading end edge, of the first arm 1 through a pivot pin 3. The distal end parts of the flat plates 2A, 2B are integrally connected to each other through a pin 13. Owing to the arrangement that the basal end parts and the distal end parts of the pair of flat plates 2A, 2B are connected to each other through the pivot pin 3 and the pin 13, the pair of flat plates 2A, 2B integrally behave as the second arm 2. A door side attachment member 14 is turnably attached to a leading end part of the second arm 2 through the pin 13. By attaching this door side attachment member 14 to a back surface of a door (not shown), the leading end part of the second arm 2 is turnably connected to the door. The pivot pin 3 and the pin 13 are arranged in parallel relation to the pin 12.

When the door is turned toward the open position, the second arm 2 is turned about the pivot pin 3 in the direction as indicated by an arrow X of FIG. 1(B) with respect to the first arm 1. When the door reaches the open position, the second arm 2 is turned to a development position as shown in FIG. 1. When the second arm 2 is turned to the development position, the longitudinal direction of the second arm 2 is generally aligned with the longitudinal direction of the leading end part of the first arm 1, and the pair of flat plates 2A, 2B are overlapped with the leading end part of the first arm 1. When the door is turned to the closed position, the second arm 2 is turned to a folded position about the pivot pin 3 in the direction as indicated by an arrow Y of FIG. 1(B) with respect to the arm 1. In the folded position, the first arm 1 and the second arm 2 are not aligned (they are diverged as they are away from the pivot pin 3) with each other. As just discussed, in this stay A, the second arm 2 is turned with respect to the first arm 1. In the description to follow, however, it is presumed for the sake of convenience of explanation that the second arm 2 is fixed and the first arm 1 is turned with respect to the second arm 2.

Figure 2:
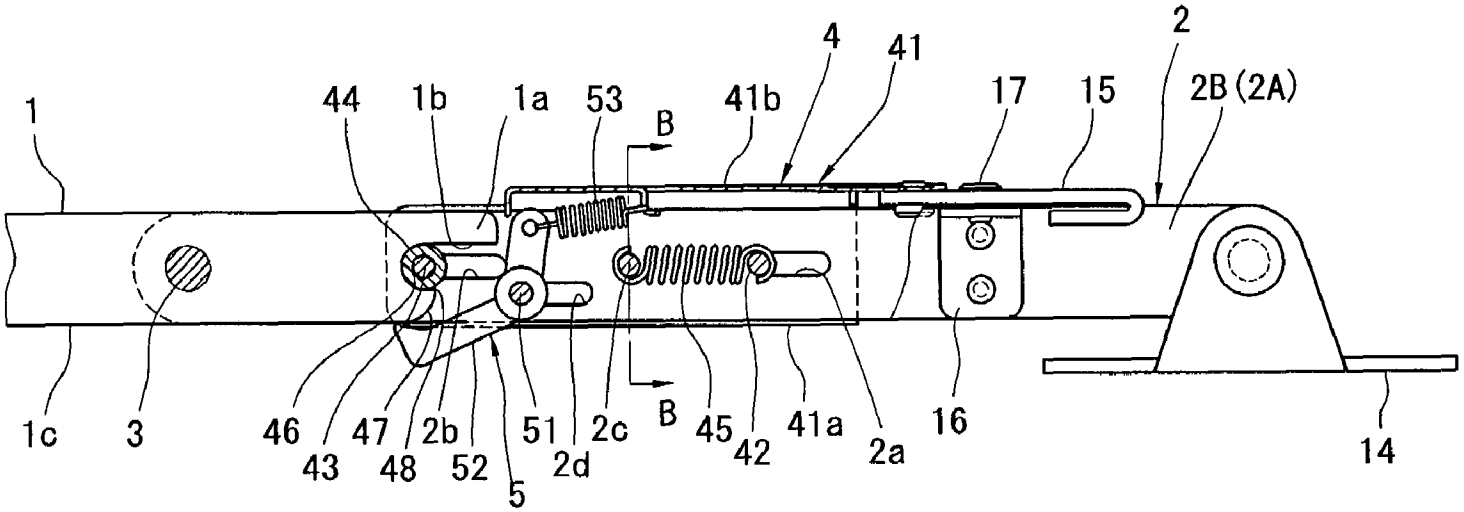
FIG. 2(A) is a front view, partly cut-away, showing an essential part of the above embodiment.
FIG. 2(B) is a sectional view taken on line B-B of FIG. 2(A).
Figure 2:
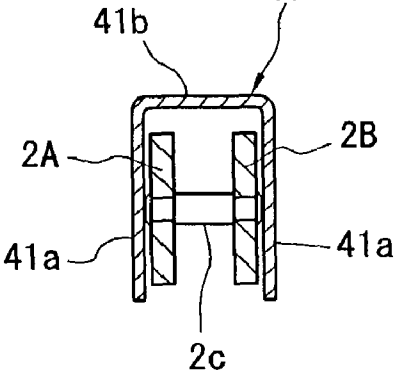

As shown in FIGS. 1 through 3, a lock means 4 is disposed between the first arm 1 and the second arm 2. The lock means 4 includes a lock member 41. The lock member 41 is formed in the shape of "U" by a pair of side plate parts 41*a*, 41*a* which are arranged parallel to each other in opposing relation, and a connecting plate part 41*b* for integrally connecting one side parts of the pair of side plate parts 41*a*, 41*a*. The lock member 41 is disposed at the second arm 2 with the opposing surfaces of the side plate parts 41*a*, 41*a* generally contacted with the surfaces facing outside of the flat plates 2A, 2B of the second arm 2 as shown in FIG. 2(B), such that the lock member 41 is movable in the longitudinal direction of the second arm 2. A regulating pin 42 is disposed parallel to the pivot pin 3 between the side plate parts 41*a*, 41*a*. This regulating pin 42 is inserted in an elongate hole 2*a* formed in the second arm 2, such that the regulating pin 42 is movable in the longitudinal direction of the elongate hole 2*a* but non-movable in the direction orthogonal to the longitudinal direction. The elongate hole 2*a* extends along the longitudinal direction of the second arm 2 Abutment of the regulating pin 42 with one and the other ends of the elongate hole 2*a* limits the range of movement of the lock member 42 in the longitudinal direction of the second arm 2. In other words, the lock member 41 is movable between a position (hereinafter, referred to as the front limit position ) where the regulating pin 42 is abutted with an end part of the elongate hole 2*a* on the basal end side of the second arm 2, and a position (hereinafter referred to as the rear limit position) where the regulating pin 42 is abutted with an end part of the elongate hole 2*a* on the leading end side of the second arm 2. This movable range is the movable range for the lock member 41.

A fixed pin 2*c* is disposed at the basal end part of the second arm 2. This fixed pin 2*c* is disposed at the basal end side of the second arm 2 with respect to the regulating pin 42. A tension coiled spring (lock biasing means) 45 is disposed between the fixed pin 2*c* and the regulating pin 42. By tensile force of this tension coiled spring 45, the lock member 41 is biased toward the basal end of the second arm 2. When the first arm 1 is located at any other position than the development position or its vicinity, the lock member 41 is located at the front limit position.

A bell crank 15 is turnably disposed at the leading end part of the second arm 2 in the vicinity of the lock member 41 through a bracket 16 and a horizontal pin 17. The lock member 41 is connected to one end part of the bell crank 15 and an operation string 18 is attached to the other end part. When this operation string 18 is pulled downward, the lock member 41 is moved toward the leading end, i.e., rear limit position, of the second arm 2 against the biasing force of the coiled spring 45.

The lock member 41 is provided at an end part (this end part is hereinafter referred to as the leading end part and the end part on the other side is referred to as the rear end part) on the first arm 1 side with an engagement pin (engagement part) 43 which is disposed parallel to the pivot pin 3. This engagement pin 43 is movably inserted in an elongate hole 2*b* which is formed in the basal end part of the second arm 2 along the longitudinal direction of the second arm 2. The elongate hole 2*b* is set in length and position such that the elongate hole 2*b* will not reduce the movable range for the lock member 41. A roller 44 having a circular shape in section is turnably fitted to the engagement pin 43.

Figure 3A:
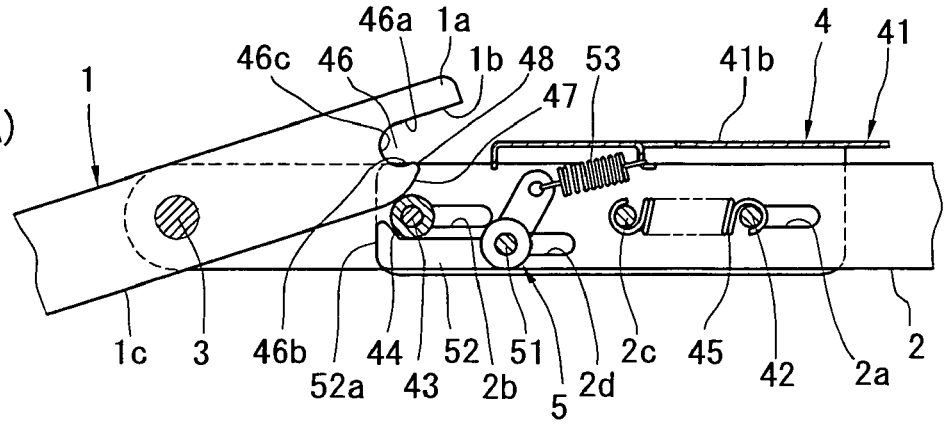
FIG. 3(A) is an explanatory view showing the operation of the above embodiment, in which a first arm is turned from a folded position toward a development position until a cam face is contacted with a roller.
Figure 3B:
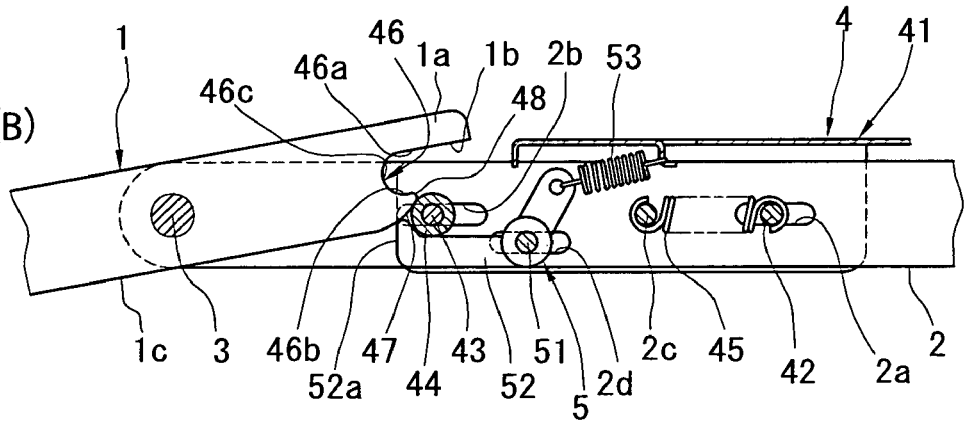
FIG. 3(B) is likewise an explanatory view, in which the first arm is turned further toward the development position.
Figure 3C:
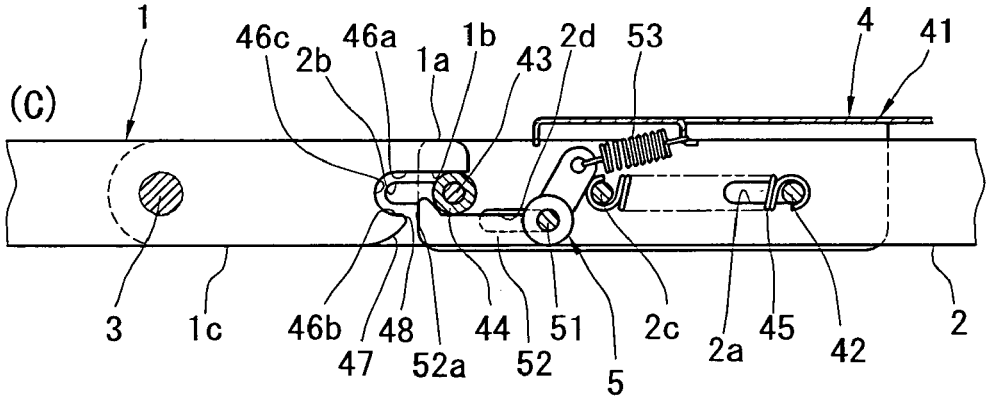
FIG. 3(C) is likewise an explanatory view, in which the first arm is turned to the development position and a lock member is moved to a rear limit position.

An engagement recess 46 is formed in a leading end face of the first arm 1. This engagement recess 46 is arranged such that when the first arm 1 is turned to the development position, its opening part is placed opposite to the roller 44 as shown in FIGS. 2 and 3(C). Moreover, the width of the engagement recess 46 is dimensioned to be generally equal to the outside diameter of the roller 44. Accordingly, when the first arm 1 is turned to the development position, the roller 44 becomes able to come into and out of the engagement recess 46 through the opening part of the engagement recess 46. With the roller 44 entered into the engagement recess 46, the outer peripheral surface of the roller 44 is generally contacted with opposite side surfaces 46*a*, 46*b* of the engagement recess 46. As a result, the first arm 1 is non-turnably locked with respect to the second arm 2 by the engagement pin 43 through the roller 44. Moreover, since the lock member 41 is biased toward the basal end (the first arm 1) of the second arm 2 by the coiled spring 45, the roller 44 is abutted with a bottom surface 46*c* of the engagement recess 46 and maintained there unless the lock member 41 is manually moved toward the leading end of the second arm 2, and the first arm 1 and the second arm 2 are maintained in a locked state by the engagement pin 43 through the roller 44. The position of the lock member 41 at the time the roller 44 is abutted with the bottom surface 46*c* of the engagement recess 46 is the locked position. This locked position is set to a position slightly away toward the leading end of the second arm 2 with respect to the front limit position of the lock member 41.

A projection part la projecting toward the second arm 2 is formed on a part (upper side part from the engagement recess 46 in FIGS. 2(A) and 3) located on the front side in the turning direction toward the folded position of the first arm 1 from the engagement recess 46 in the leading end face of the first arm 1. A side surface 1*b* facing the engagement recess 46 of the projection part 1*a* is formed as a flat surface formed by extension of the side surface 46*a* of the engagement recess 46. Moreover, as shown in FIG. 3(C), the length of the side surface 1*b* is set such that even if the lock member 41 is moved to the rear limit position when the first arm 1 is located in the development position, the side surface 1*b* can contact the roller 44. Accordingly, the first arm 1 is not turned beyond the development position in the direction from the folded position toward the development position.

The side surface 46*b* of the engagement recess 46 is set in length such that when the lock member 41 moves toward the leading end of the second arm 2 and then moves beyond a released position as later described, the roller 44 is located on the leading end side of the second arm 2 from the distal end of the side surface 46*b*. Accordingly, when the lock member 41 is moved toward the leading end side of the second arm 2 from the released position, the first arm 1 becomes able to turn toward the folded position with respect to the second arm 2.

A cam face (inclination surface; first abutment part) 47 is formed on a part (lower side part from the engagement recess 46 in FIGS. 2(A) and 3) located at the front side in the turning direction toward the development position of the first arm 1 from the engagement recess 46 in the leading end face of the first arm 1. This cam face 47 is formed in a generally quarter arcuate shape and is separated from the engagement recess 46 toward the basal end from the leading end of the first arm 1. An arcuate surface (third abutment part) 48 having a small radius of curvature is formed on one end part (hereinafter referred to as the distal end part) of the cam face 47 on the leading end side of the first arm 1. One end part of this arcuate surface 48 is in contact with the cam face 47 and the other end part is in contact with the side surface 46*b* of the engagement recess 46. The cam face 47 may be formed in an inclination surface which is linearly inclined. Also, the arcuate surface 48 may be formed as a planar surface which is orthogonal to the side surface 46*b* and intersected with the arcuate surface (inclination surface) 48.

A rear end part of the cam face 47 is smoothly in contact with a side surface (lower-side side surface of the first arm 1 in FIGS. 2 and 3) directing in the development turning direction of the first arm 1. As shown in FIG. 3(A), the cam face 47 is arranged such that when the first arm 1 is turned from the folded position to a predetermined position in the vicinity of the development position with the lock member 41 located in the front limit position, the rear end part of the cam face 47 is abutted with an outer peripheral surface of the roller 44. Accordingly, when the first arm 1 is turned further toward the development position, the roller 44 is urged toward the leading end of the second arm 2 by the cam face 47 and the lock member 41 is moved in the same direction against the biasing force of the coiled spring 45. Thereafter, when the first arm 1 is turned further toward the development position, the arcuate surface 48 is contacted with the roller 44. When the arcuate surface 48 is contacted with the most projecting part toward the basal end of the second arm 2 in the outer peripheral surface of the roller 44, the lock member 41 is moved most closely toward the leading end of the second arm 2. The distance of movement from the lock position of the lock member 41 at that time is the releasing distance and the position of the lock member 41 at that time is the released position. Thereafter, when the first arm 1 is turned further toward to the development position, thereby the most projecting part toward the basal end of the second arm 2 in the outer peripheral surface of the roller 44 overrides the arcuate part 48, the roller 44 becomes able to enter the engagement recess 46. Accordingly, when the first arm 1 is turned further toward the development position, the roller 44 is brought into the engagement recess 46 and the lock member 41 is moved toward the basal end of the second arm 2 by the coiled spring 45. When the first arm 1 reaches the development position, the lock member 41 reaches the locked position and stops. Accordingly, in this stay A, when the first arm 1 is turned from the folded position toward the development position, the first arm 1 and the second arm 2 are automatically non-turnably locked by the lock means 4.

A movement prohibiting means (retaining means) 5 is disposed between the first arm 1 and the lock member 41. That is, a support pin 51 parallel to the engagement pin 43 is disposed at the distal end part of the lock member 41. The support pin 51 is disposed at the leading end side of the second arm 2 with respect to the engagement pin 43. The support pin 51 is movably inserted in an elongate hole 2*d* which is formed in the basal end part of the second arm 2 along the longitudinal direction of the second arm 2. This elongate hole 2*d* is set in length and position such that the elongate hole 2*d* will not reduce the movable range of the lock member 41.

An intermediate part of a bell crank type turnable member (displacement member) 52 is turnably fitted to the support pin 51. A tension coiled spring (displacement biasing means) 53 is disposed between a basal end part (end part on the leading end side of the second arm 2) of the turnable member 52 and the lock member 41. By tension biasing force of this coiled spring 53, the turnable member 52 is turn biased clockwise in FIGS. 2 and 3. The distal end part of the turnable member 52 is abutted with the engagement pin 43 by the biasing force of the coiled spring 53 through the roller 44. The position of the turnable member 52 at that time is the second position. Accordingly, in the stay A of this embodiment, the engagement pin 43 is also used as a second abutment part. This might be apparent from the fact that the roller 44 may be integrally formed on the engagement pin 43 instead of being turnably formed thereon.

When the first arm 1 is turned from the folded position toward the development position with the lock member 41 located at the front limit position and the turnable member 52 located at the second position (see FIG. 3(A)), the cam face 47 is abutted with the roller 44 as mentioned above. When the first arm 1 is turned further toward the development position and the arcuate surface 48 passes through a part most closely located on the basal end of the second arm 2 in the outer peripheral surface of the roller 44 toward the development position, the roller 44 is brought into the engagement recess 46 in accordance with the turning movement of the first arm 1 toward the development position and the lock member 41 is moved toward the basal end of the second arm 2 by the coiled spring 45. Then, the distal end part of the turnable member 52 is contacted with the cam face 47. Thus, when the first arm 1 is turned further toward the development position, the turnable member 52 is turned counterclockwise in FIGS. 2 and 3 by the cam face 47 against the biasing force of the coiled spring 53. When the first arm 1 reaches the development position, the roller 44 is abutted with the bottom surface 46*c* of the engagement recess 46 as shown in FIG. 2. By this, the lock member 41 is stopped at the locked position. When the lock member 41 is stopped at the locked position, the distal end part of the turnable member 52 is in abutment with the rear end part of the cam face 47. The position of the turnable member 52 at that time is the first position. Accordingly, in this stay A, the cam face 47 also serves as the first abutment part. It is also accepted that the turnable member 52 is abutted with a side surface 1*c* of the first arm 1 and the position of the turnable member 52 at that time is the first position.

The biasing force of the coiled spring 53 is set to be as small as possible within a range able to turn the turnable member 52. The biasing force of the coiled spring 53 is, of course, much smaller than the biasing force of the coiled spring 45. Moreover, the biasing force of the coiled spring 53 is not so large as being able to turn the first arm 1 through the cam face 57. Accordingly, it never occurs that the coiled spring 53 exerts influence on the movement of the lock member 41 or the coiled spring 53 turns the first arm 1 toward the folded position through the turnable member 52.

Figure 3D:
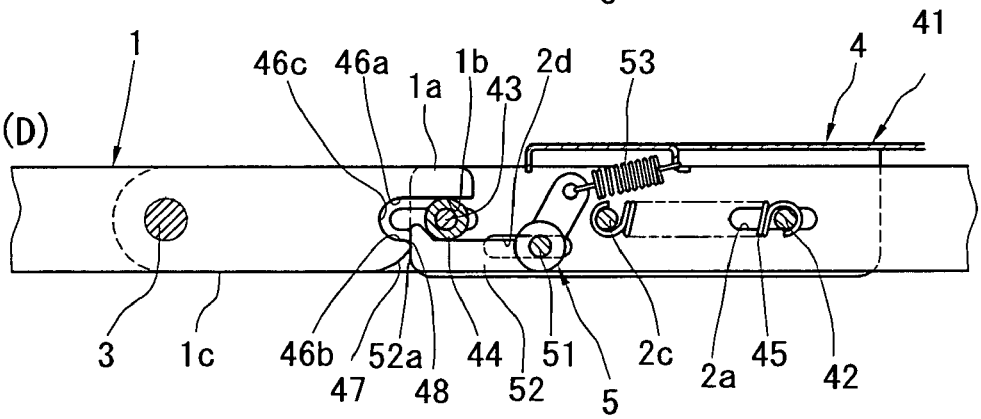
FIG. 3(D) is likewise an explanatory view, in which the first arm is turned to the development position and the lock member is moved to a release retaining position.

An abutment surface 52*a* is formed on the distal end face of the turnable member 52. This abutment surface 52*a* is formed such that when the turnable member 52 is turned to the second position, the abutment surface 52*a* is generally orthogonal to the acting direction (longitudinal direction of the second arm 2) of the biasing force of the coiled spring 45. Moreover, the abutment surface 52*a* is abutted with the arcuate surface 48, when the lock member 41 is moved from the rear limit position to a predetermined position toward the basal end of the second arm 2 with the first arm 1 located at the development position and the turnable member 52 located at the second position, as shown in FIGS. 3(C) and 3(D). By this, the lock member 41 is prohibited from moving toward the basal end of the second arm 2. The position of the lock member 41 at that time is the release retaining position. Thus, the arcuate surface 48 serves as the third abutment part. The release retaining position is located on the leading end of the second arm 2 from the above-mentioned released position. Accordingly, when the lock member 41 is located at the release retaining position, the roller 44 is brought out of the engagement recess 46 and located on the leading end of the second arm 2 with respect to the side surface 46*b* of the engagement recess 46. Thus, the first arm 1 is allowed to turn from the development position toward the folded position. It is such designed that the line connecting the abutment part between the abutment surface 52*a* and the arcuate surface 48 and the center of the support pin 51 is generally parallel to the acting direction of the biasing force of the coiled spring 45. Accordingly, abutment of the arcuate surface 48 with the abutment surface 52*a* never causes the turnable member 52 to turn against the biasing force of the coiled spring 53.

In the stay A thus constructed, it is presumed that currently, the first arm 1 is located at the folded position, the lock member 41 is located at the front limit position and the turnable member 52 is located at the second position. When the first arm 1 is turned from the folded position to the development position in that state, as shown in FIG. 2, the lock member 41 is moved to the locked position and the turnable member 52 is moved to the first position. In accordance with the movement of the lock member 41 to the locked position, the roller 44 is brought into the engagement recess 46. By this, the first arm 1 is non-turnably locked at the development position with respect to the second arm 2.

In case the first arm 1 locked at the development position is to be turned to the folded position, the operation string 18 is pulled downward, so that the lock member 41 is moved to toward the rear limit position as shown in FIG. 3(C). Then, the distal end part of the turnable member 52 is sequentially slidingly moved on the cam face 47 and the arcuate surface 48 in accordance with the movement of the lock member 41. When the lock member 41 is moved to the release retaining position, the turnable member 52 is abutted with the roller 44 and stopped at the second position. Thereafter, the lock member 41 is moved to the rear limit position. It is not necessarily required that the lock member 41 is moved to the rear limit position but it is good enough if the lock member 41 is moved from the release retaining position toward the rear limit position. Thereafter, the operation string 18 is released. Then, the lock member 41 is moved toward the basal end of the second arm 2 by the biasing force of the coiled spring 45. When the lock member 41 is moved to the release retaining position, the abutment surface 52*a* of the movable member 52 is abutted with the arcuate surface 48 (see FIG. 3(D)). By this, the lock member 41 is stopped at the release retaining position. At that time, the roller 44 is already brought out of the engagement recess 46. Thus, the lock means 4 is maintained in its released state. Accordingly, even if the door is large or the door is of the type opening upward, or even if two or more stays A are used, the door can be turned easily from the open position toward the closed position.

When the first arm 1 is turned from the development position toward the folded position, the arcuate surface 48 is slidingly moved on the abutment surface 52*a* toward the folded position. When the arcuate surface 48 is separated from the abutment surface 52*a* toward the folded position, the roller 44 is contacted with the cam face 47. As a result, in accordance with the turning movement of the first arm 1 toward the folded position, the lock member 41 is moved by the coiled spring 45 toward the basal end of the second arm 2. When the first arm 1 is turned beyond the position shown in FIG. 3(A) toward the folded position, the lock member 41 reaches the front limit position and is restored into its original state.

It should be noted here that the present invention should not be limited to the above-mentioned embodiment. Instead, many changes and modifications can be made, where necessary, without departing from the subject matter of the invention.

For example, in the above-mentioned embodiment, the first arm 1 is attached to the skeleton and the second arm 2 is attached to the door. It is also accepted that the first arm 1 is attached to the door and the second arm 2 is attached to the skeleton.

Moreover, in the above-mentioned embodiment, the turnable member 52, which is turningly displaced about the support pin 51, is used as a displacement member. It is also accepted that a member, which is linearly displaced in the direction orthogonal to the moving direction of the lock member 41.

INDUSTRIAL APPLICABILITY

A stay according to the present invention can be used, for example, as a stay disposed between a skeleton and a large-sized door which is of the type opening upward, and particularly, as stays which are disposed between a skeleton and the left and right side parts of a door and adapted to hold the door at the open position.

The invention claimed is:

1. A stay comprising:

a first arm, a second arm whose basal end part is turnably connected to a leading end part of said first arm between a development position and a folded position, and a lock means disposed between said first arm and said second arm, said lock means being switched between a locked state where said second arm can non-turnably be locked in said development position and a released state where said second arm is allowed to turn from said development position toward said folded position, and a retaining means for retaining said lock means in said released state when said second arm is located in said development position, wherein said lock means comprises:

a lock member movably disposed at said second arm within a predetermined movable range, and a lock biasing means for biasing said lock member, wherein when said lock member is moved to a predetermined locked position within said movable range with said second arm located in said development position, said lock member is engaged with said first arm to prohibit said second arm from turning from said development position toward said folded position, wherein when said lock member is moved away from said locked position by a predetermined releasing distance or more with said second arm located in said development position, said lock member is disengaged from said first arm to allow said second arm to turn from said development position toward said folded position, and wherein said lock biasing means biases said lock member toward said locked position so that the engaging state of said lock member with said first arm can be maintained, wherein said retaining means comprises a movement prohibiting means disposed between selected one of said first and second arms, and said lock member and is adapted to prohibit said lock member from moving toward said locked position beyond a predetermined release retaining position which is away by more than said releasing distance from said locked position, and wherein said movement prohibiting means is disposed between said first arm and said lock member, said movement prohibiting means comprising:

a displacement member disposed at said lock member such that said displacement member can displace between a first position and a second position, a displacement biasing means for biasing said displacement member from said first position toward said second position, a first abutment part disposed at said first arm, said first abutment part being abutted with said displacement member so that said displacement member is brought into said first position when said second arm is located at said development position and said lock member is located at said locked position and allowing said displacement member to move to said second position when said lock member is moved beyond said release retaining position, a second abutment part disposed at said lock member and abutted with said displacement member so that said displacement member is brought into said second position against the biasing force of said displacement biasing means, and a third abutment part disposed at said first arm and abutted with said displacement member which is located at said second position, thereby preventing said lock member from moving from said release retaining position toward said locked position.

2. A stay according to claim 1, wherein said first arm is provided with an engagement recess formed therein and partly open, and said lock member is provided with an engagement part formed thereon, said engagement part being brought into engagement with said engagement recess through an opening part of said engagement recess thereby prohibiting said second arm from turning toward said folded position from said development position when said second arm is located at said development position and said lock member is moved from said release retaining position to said locked position.

3. A stay according to claim 2, wherein said first abutment part is formed as an inclination surface which is inclined in such a manner as to approach the opening part of said engagement recess from said locked position toward said release retaining position, and said third abutment part is formed as a leading end part of said inclination surface which is intersected with an end part on the opening side of one side surface of said engagement recess.

4. A stay according to claim 3, wherein said displacement member is turnably disposed at said lock member, said engagement part is also used as said second abutment part, said displacement member is abutted with a rear end part, which is away from said engagement recess, of said inclination surface, thereby causing said displacement member to be located at said first position when said second arm is located at said development position and said lock member is located at said locked position, said displacement member is slid on said inclination surface and turned toward said second position as said lock member is moved from said lock position toward said released position, and said displacement member is moved beyond said inclination surface and abutted with said engagement part thereby being located at said second position when said lock member reaches said release retaining position.

5. A stay according to claim 4, wherein when said second arm is turned from said folded position toward said development position with said lock member located in a moving limit position toward said first arm within said predetermined movable range, said engagement part is brought into abutment with said inclination surface, thereby said lock member is moved toward said release retaining position in accordance with turning movement of said second arm against the biasing force of said lock biasing means, and when said second arm reaches said development position, said lock member is moved to said locked position by said lock biasing means, thereby said engagement part is inserted into said engagement recess through said opening part of said engagement recess.

6. A stay according to claim 5, wherein when said lock member is moved to said locked position by said lock biasing means, said displacement member is moved by said inclination surface from said second position to said first position against the biasing force of said displacement biasing means.

* * * * *